US011988066B2

(12) United States Patent
Loehken et al.

(10) Patent No.: US 11,988,066 B2
(45) Date of Patent: May 21, 2024

(54) DYNAMIC UNDERBALANCE SUB

(71) Applicant: DynaEnergetics Europe GmbH, Troisdorf (DE)

(72) Inventors: Joern Olaf Loehken, Troisdorf (DE); Stefan Purcelean, Troisdorf (DE); Paula Feitoza Nascimento, Troisdorf (DE); Bernd Fricke, Hannover (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/920,441

(22) PCT Filed: Jun. 16, 2021

(86) PCT No.: PCT/EP2021/066167

§ 371 (c)(1),
(2) Date: Oct. 21, 2022

(87) PCT Pub. No.: WO2021/255058

PCT Pub. Date: Dec. 23, 2021

(65) Prior Publication Data

US 2023/0160279 A1 May 25, 2023

Related U.S. Application Data

(60) Provisional application No. 63/079,705, filed on Sep. 17, 2020, provisional application No. 63/079,699,
(Continued)

(51) Int. Cl.

| | |
|---|---|
| ***E21B 34/06*** | (2006.01) |
| ***E21B 43/117*** | (2006.01) |
| ***E21B 43/1185*** | (2006.01) |

(52) U.S. Cl.
CPC ..... *E21B 34/063* (2013.01); *E21B 43/117* (2013.01); *E21B 43/11855* (2013.01)

(58) Field of Classification Search
CPC ..... E21B 34/063; E21B 43/117; E21B 43/11855; E21B 43/1185; E21B 43/116
See application file for complete search history.

(56) References Cited

U.S. PATENT DOCUMENTS

| | | | |
|---|---|---|---|
| 3,994,338 | A | 11/1976 | Hix |
| 4,515,217 | A | 5/1985 | Stout |

(Continued)

FOREIGN PATENT DOCUMENTS

| | | |
|---|---|---|
| CA | 2 271 620 | 10/2007 |
| EP | 3 218 575 B1 | 10/2018 |

(Continued)

OTHER PUBLICATIONS

GEODYNAMICS; Dynamic Underbalance Perforating Improves Well Productivity in Thailand; dated 2017; 1 page.

(Continued)

*Primary Examiner* — James G Sayre
(74) *Attorney, Agent, or Firm* — Womble Bond Dickinson (US) LLP

(57) ABSTRACT

A dynamic underbalance sub for use in a wellbore may include a sub housing, a first chamber provided in an interior of the sub housing, an opening extending through the sub housing and configured such that the first chamber is in fluid communication with an exterior of the sub housing, a second chamber provided in the interior of the sub housing, and a pressure-isolating wall provided between the first chamber and the second chamber.

19 Claims, 9 Drawing Sheets

Related U.S. Application Data filed on Sep. 17, 2020, provisional application No. 63/040,979, filed on Jun. 18, 2020.

(56) References Cited

U.S. PATENT DOCUMENTS

| | | | |
|---|---|---|---|
| 4,862,964 | A | 9/1989 | George et al. |
| 6,220,370 | B1 | 4/2001 | Wesson et al. |
| 6,732,798 | B2 | 5/2004 | Johnson et al. |
| 7,036,594 | B2 | 5/2006 | Walton et al. |
| 7,096,954 | B2 | 8/2006 | Weng et al. |
| 7,182,138 | B2 | 2/2007 | Behrmann et al. |
| 7,243,725 | B2 | 7/2007 | George et al. |
| 7,287,589 | B2 | 10/2007 | Grove et al. |
| 7,451,819 | B2 | 11/2008 | Chang et al. |
| 7,478,687 | B2 | 1/2009 | Lynde et al. |
| 7,571,768 | B2 | 8/2009 | Cuthill |
| 7,712,521 | B2 | 5/2010 | Sorensen |
| 7,712,532 | B2 | 5/2010 | Walton |
| 7,806,035 | B2 | 10/2010 | Kaiser et al. |
| 7,905,285 | B2 | 3/2011 | Cuthill |
| 8,215,397 | B2 | 7/2012 | Griffith |
| 8,336,437 | B2 | 12/2012 | Barlow et al. |
| 8,408,308 | B2 | 4/2013 | Busaidy |
| 8,726,995 | B2 | 5/2014 | Bell et al. |
| 8,726,996 | B2 | 5/2014 | Busaidy et al. |
| 8,807,003 | B2 | 8/2014 | Le et al. |
| 8,807,213 | B2 | 8/2014 | Walker et al. |
| 8,807,231 | B2 | 8/2014 | Reinhardt et al. |
| 9,080,430 | B2 | 7/2015 | Busaidy |
| 9,091,134 | B2 | 7/2015 | Vick |
| 9,194,209 | B2 | 11/2015 | Frazier |
| 9,291,031 | B2 | 3/2016 | Frazier |
| 9,382,778 | B2 | 7/2016 | Frazier |
| 9,394,767 | B2 * | 7/2016 | Brooks ..... F42D 1/04 |
| 9,593,542 | B2 | 3/2017 | Getzlaf et al. |
| 9,605,514 | B2 | 3/2017 | Holly et al. |
| 9,759,048 | B2 | 9/2017 | LaGrange et al. |
| 10,337,301 | B2 | 7/2019 | Harive |
| 10,597,987 | B2 | 3/2020 | Escudero et al. |
| 10,704,357 | B2 | 7/2020 | Roessler et al. |
| 10,927,649 | B2 | 2/2021 | Barker et al. |
| 2011/0011587 | A1 * | 1/2011 | Al Busaidy ..... E21B 43/117 166/55.1 |
| 2015/0337629 | A1 * | 11/2015 | Zhang ..... E21B 43/25 166/250.01 |
| 2020/0040704 | A1 | 2/2020 | Escudero et al. |

FOREIGN PATENT DOCUMENTS

| | | | |
|---|---|---|---|
| EP | 3464797 | B1 | 2/2020 |
| NO | 340634 | B1 | 5/2017 |
| NO | 340798 | B1 | 6/2017 |
| WO | 2015152907 | A1 | 10/2015 |
| WO | 2017076869 | A1 | 5/2017 |
| WO | 2021255058 | A1 | 12/2021 |

OTHER PUBLICATIONS

International Searching Authority; International Search Report and Written Opinion of the International Searching Authority for PCT/EP2021/066167; dated Sep. 29, 2021; 12 pages.

Owen Oil Tools; Core Lab Dynamic Underbalance System; dated 2009; 8 pages.

GeoDynamics Engineered Perforating Solutions, "Debris Sub Assembly," 1 p.

* cited by examiner

DYNAMIC UNDERBALANCE SUB

CROSS-REFERENCE TO RELATED APPLICATIONS

The present application is a national stage application of and claims priority to Patent Cooperation Treaty (PCT) Application No. PCT/EP2021/066167 filed Jun. 16, 2021, which claims priority to U.S. Provisional Patent Application No. 63/040,979 filed Jun. 18, 2020, U.S. Provisional Patent Application No. 63/079,699 filed Sep. 17, 2020, and U.S. Provisional Patent Application No. 63/079,705 filed Sep. 17, 2020, the contents of each of which are hereby incorporated by reference in their entirety.

BACKGROUND

In oil and gas wellbore completion operations, perforating guns with shaped charges are commonly used to puncture holes into a wellbore casing and to create a hydraulic connection between the oil, gas, or water bearing reservoir and the wellbore. The jet of a shaped charge punches a hole in the surrounding wellbore casing and travels into the rock formation of the reservoir. The grains of the formation are destroyed, and their remains are pushed radially away from the axial center of the jet, thereby forming an elongated cavity in the rock. This cavity is also referred as "tunnel" or "perforation tunnel." The crushed grains and the debris from the perforation jet remain in a large portion in the perforation tunnel. These remains or crushed grains can reduce the permeability of the rock and thereby reduce or even block the flow path of fluid or gas towards the wellbore. The layer of crushed grains with reduced permeability is sometimes referred to as the "skin effect" or even perforating damage.

A local underpressure (i.e., a negative pressure) can be used to extract the remains from the perforation tunnel. In general, an empty container at ambient pressure is connected to the perforating gun and deployed to the wellbore. After initiation of the perforating gun a vent or valve rapidly opens the empty container in close proximity to the perforation tunnels. The wellbore fluid will flow into the container and create a local negative pressure for the time until the container is filled. This temporary pressure drop is called "dynamic underbalance." The local pressure in the wellbore will drop for a short period of time under the pressure of the reservoir pressure in the rock formation. This effect causes a rapid flow from the perforation tunnel, which can flush a high amount of debris from the tunnel into the wellbore and causes a cleaning of the tunnel. The amount of the dynamic underbalance may increase with the size of the opening into the ambient pressure container and the speed at which the hole is opened.

Accordingly, it may be desirable to develop a dynamic underbalance mechanism with a fast opening valve or opening to the ambient pressure container. Further it may be desirable to develop a dynamic underbalance system that can be easily connected to a wellbore tool string and easily, quickly, and reliably actuated in a wellbore environment.

BRIEF SUMMARY

An exemplary embodiment of a dynamic underbalance sub for use in a wellbore may include a sub housing, a first chamber provided in an interior of the sub housing, an opening extending through the sub housing and configured such that the first chamber is in fluid communication with an exterior of the sub housing, a second chamber provided in the interior of the sub housing, and a pressure-isolating wall provided between the first chamber and the second chamber.

A wellbore tool string for use in a wellbore may include a first wellbore tool and a dynamic underbalance sub. The wellbore tool may include a tool housing and a tool explosive provided within the tool housing. The dynamic underbalance sub may include a sub housing, a first chamber provided in an interior of the sub housing, an opening extending through the sub housing and configured such that the first chamber is in fluid communication with an exterior of the sub housing, a second chamber provided in the interior of the sub housing, a pressure-isolating wall provided between the first chamber and the second chamber, and a shaped charge ballistically coupled to the tool explosive and positioned to break or perforate the pressure-isolating wall in response to detonation of the tool explosive.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
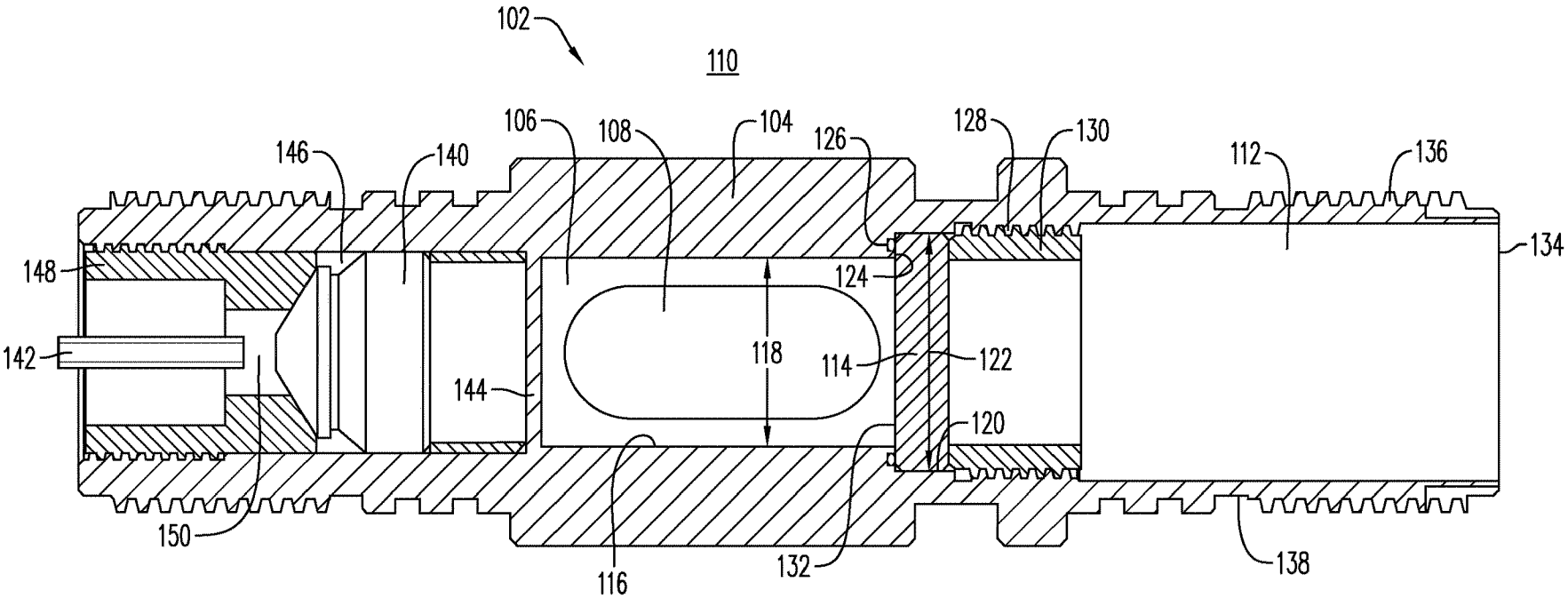
FIG. 1 illustrates a cross section of a dynamic underbalance sub according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment."

FIG. 1 illustrates an exemplary embodiment of a dynamic underbalance sub 102. The dynamic underbalance sub 102 may include a sub housing 104. The sub housing 104 may be formed of steel. The dynamic underbalance sub 102 may further include a first chamber 106 provided in an interior of the sub housing 104. An opening 108 may be provided in a side of the sub housing 104 such that the first chamber 106 is in fluid communication with an exterior 110 of the dynamic underbalance sub 102. In other words, when the dynamic underbalance sub 102 is deployed in a well, a pressure within the first chamber 106 may be equal to a wellbore pressure.

The dynamic underbalance sub 102 may further include a second chamber 112 provided in the interior of the sub housing 104. The second chamber 112 may be pressure-sealed from the first chamber 106 such that the pressure within the second chamber 112 may be maintained independently from the pressure within the first chamber 106. For example, a pressure-isolating wall 114 may be provided between the first chamber 106 and the second chamber 112 at a second chamber first end 132 of the second chamber 112.

As further seen in FIG. 1, the second chamber 112 may be open at a second chamber second end 134 that is spaced apart from the second chamber first end 132 in the axial direction. As explained in detail herein, a container 210 (see FIG. 2) may be coupled at the second chamber second end 134 in order to seal the second chamber 112. Alternatively, the dynamic underbalance sub 102 may be formed such that the second chamber 112 is closed at the second chamber second end 134.

In an exemplary embodiment, the second chamber 112 may be sealed at a surface so as to set a pressure of the second chamber 112 approximately equal to a surface atmospheric pressure. Accordingly, in an exemplary embodiment, the pressure in the second chamber 112 may be lower than the wellbore pressure when the dynamic underbalance sub 102 is deployed in a wellbore.

The pressure-isolating wall 114 may be configured so as to be be breached, perforated, shattered, or otherwise broken by a shaped charge 140. In an exemplary embodiment, the pressure-isolating wall 114 may include a brittle material such as glass or ceramic. In a further exemplary embodiment, the pressure-isolating wall 114 may include a borosilicate glass, a soda lime glass, or a soda lime silicate glass. In a further exemplary embodiment, the pressure-isolating wall 114 may be formed as a disc inserted into the second chamber 112. Forming the pressure-isolating wall 114 of a brittle material helps to ensure that a substantial portion of the pressure-isolating wall 114 shatters, breaks, or disintegrates when the shaped charge 140 is initiated, thereby providing a larger hole between the first chamber 106 and the second chamber 112 in order to increase the dynamic underbalance. In comparison, if the pressure-isolating wall 114 was made by a malleable material such as a metal, the shaped charge 140 may only create a small perforation hole in the pressure-isolating wall 114, thereby reducing the dynamic underbalance.

FIG. 1 further shows that the first chamber 106 may include a first interior surface 116 having a first diameter 118, and the second chamber 112 may include a second interior surface 120 having a second diameter 122. The second diameter 122 may be larger than the first diameter 118. A shoulder 124 may extend between the first diameter 118 and the second chamber second diameter 122. As noted above, the pressure-isolating wall 114 may be formed as a disc inserted into the second chamber 112, in which case the pressure-isolating wall 114 may abut against shoulder 124. A seal element 126 may be provided between the pressure-isolating wall 114 and the sub housing 104. For example, as seen in FIG. 1, the seal element 126 may be provided in a groove formed in the shoulder 124. Alternatively, the seal element 126 may be provided between an outer circumferential surface of the pressure-isolating wall 114 and the second interior surface 120. In an exemplary embodiment, the seal element 126 may be an O-ring. However, it will be understood that the seal element 126 is not limited to an O-ring, and other seals including, but not limited to, liquid seals, foam seals, resins, polymers, coatings, or other suitable seal material. The seal element 126 may help to improve the seal between the first chamber 106 and the second chamber 112, and may help to improve the pressure rating of the dynamic underbalance sub 102. Additionally, the seal element 126 may help to improve reusability of the dynamic underbalance sub 102 (and the dynamic underbalance sub 302 discussed in detail herein with reference to FIG. 3).

In an exemplary embodiment, the dynamic underbalance sub 102 may further include second chamber internal threads 128 formed on second interior surface 120. A lock ring 130 may be threadedly engaged with the second chamber internal threads 128 so as to abut the pressure-isolating wall 114 and keep the pressure-isolating wall 114 pressed against the shoulder 124 so as to maintain the seal between the first chamber 106 and the second chamber 112.

The dynamic underbalance sub 102 may further include sub housing external threads 136 formed on an outer surface 138 of the sub housing 104. As explained in detail herein, a container 210 may be threadedly engaged with the sub housing external threads 136.

As noted above, the dynamic underbalance sub 102 may include a shaped charge 140. The shaped charge 140 may be positioned so as to break the pressure-isolating wall 114 in response to an initiation or detonation of the shaped charge. In other words, an aiming direction of the shaped charge 140 may be aligned so as to intersect with the pressure-isolating wall 114. The shaped charge 140 may be provided in a shaped charge chamber 146 adjacent to the first chamber 106 and opposite the second chamber 112. A separation wall 144 may be provided between the shaped charge chamber 146 and the first chamber 106. When the shaped charge 140 is detonated, the resultant perforating jet will puncture the separation wall 144, propagate through the first chamber 106, and then shatter or otherwise break the pressure-isolating wall 114. The shaped charge 140 may be held in place within the shaped charge chamber 146 via a charge retainer 148 that may be threadedly engaged with the sub housing 104. The dynamic underbalance sub 102 may further include a booster 142 ballistically coupled to the shaped charge 140. The booster 142 may be ballistically coupled to an upstream first wellbore tool such as a perforating gun such that when the perforating gun is initiated, the booster 142 is also initiated, thereby initiating the shaped charge 140.

FIG. 1 further shows a gap 150 between the booster 142 and the shaped charge 140. However, it will be understood that the gap 150 is not required, and that, in an exemplary embodiment, the gap 150 may be reduced or even eliminated.

Figure 2:
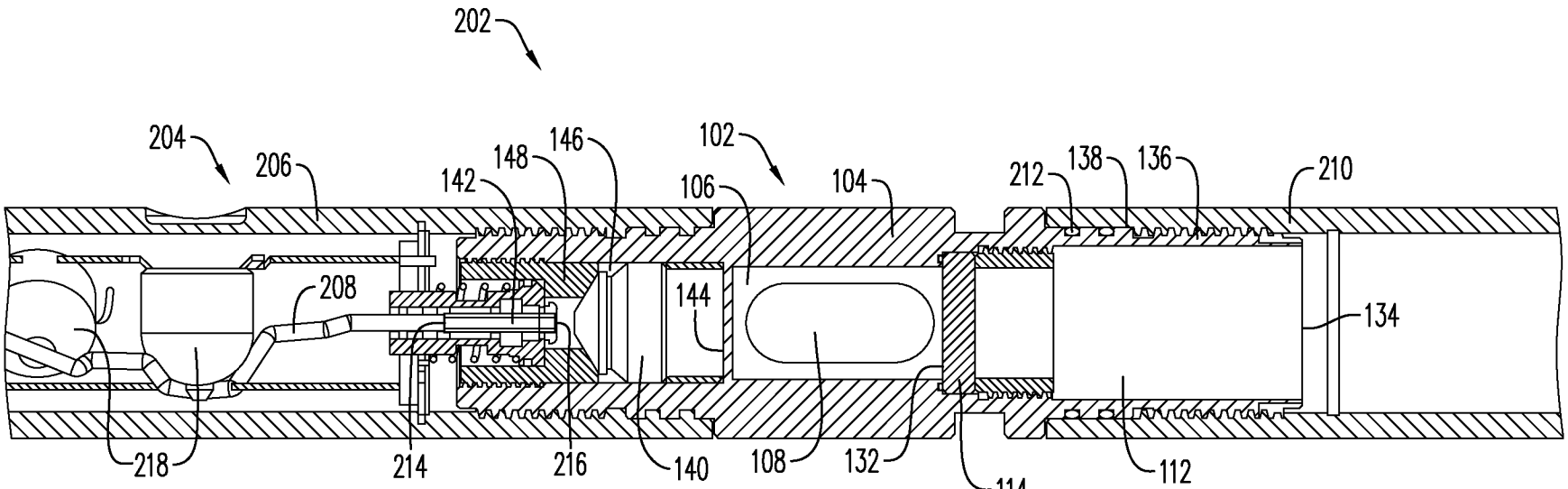
FIG. 2 illustrates a cross section of a wellbore tool string according to an exemplary embodiment.

FIG. 2 shows an exemplary embodiment of a wellbore tool string 202. The wellbore tool string 202 may include a first wellbore tool 204 and the dynamic underbalance sub 102. The dynamic underbalance sub 102 may be threadedly coupled to a tool housing 206 of the first wellbore tool 204.

As seen in FIG. 2, the first wellbore tool 204 may include the tool housing 206 and a tool explosive 208 provided within the tool housing 206. In an exemplary embodiment, the first wellbore tool 204 may be a perforating gun and the tool explosive 208 may be a detonating cord. The first wellbore tool 204 may include shaped charges 218 configured to be initiated by the tool explosive 208.

As further seen in FIG. 2, a container 210 may be threadedly engaged with the sub housing external threads 136 such that the second chamber second end 134 is disposed within the container 210. A seal element 212 may be provided between the container 210 and the sub housing 104. In an exemplary embodiment, the seal element 212 may be an O-ring. However, it will be understood that the seal element 212 is not limited to an O-ring and other seals including, but not limited to, liquid seals, foam seals, resins, polymers, coatings, or other suitable seal material.

The container 210 may be configured as a cylinder with an open end and a closed end. In an exemplary embodiment, the container 210, the seal element 212, the pressure-isolating wall 114, and the seal element 126 may combine to pressure-seal the second chamber 112 such that the pressure within the second chamber 112 may be maintained regardless of the pressure in the first chamber 106. The container 210 may be manufactured in a variety of lengths so as to allow the second chamber 112 to be set to a variety of volumes depending on the specific application and amount of dynamic underbalance required. In other words, a longer container 210 would result in a larger volume of the second chamber 112, thereby increasing the dynamic underbalance.

As further seen in FIG. 2, the booster 142 may include a booster first end 214 and a booster second end 216. When the dynamic underbalance sub 102 is coupled to the first wellbore tool 204, the booster first end 214 may be provided proximate to the tool explosive 208 such that the booster 142 is ballistically coupled to the tool explosive 208. In other words, the booster 142 is positioned such that when the tool explosive 208 is initiated, the initiation of the tool explosive 208 will subsequently initiate that booster 142. The booster second end 216 may be provided proximate to the shaped charge 140 such that the shaped charge 140 is ballistically coupled to the booster 142. Thus, overall, the shaped charge 140 may be ballistically coupled to the tool explosive 208. In other words, initiation of the tool explosive 208 may ultimately cause initiation of the shaped charge 140 to break the pressure-isolating wall 114 and create the dynamic underbalance.

Because the second chamber 112 is maintained at a pressure lower than the wellbore pressure, for example, at surface atmospheric pressure, the breaking of the pressure-isolating wall 114 caused by the initiation of the shaped charge 140 creates a significant pressure differential between the first chamber 106 and the second chamber 112. The pressure differential causes the wellbore fluid to rapidly fill the second chamber 112, thereby creating the desired dynamic underbalance. This causes a rapid inflow from the wellbore into the first chamber 106 through the opening 108.

The exemplary embodiments described above may result in significant advantages over conventional dynamic underbalance systems. For example, the opening of the second chamber 112 has the velocity of a shaped charge explosion and by far exceeds the sonic velocity. In other words, opening of the second chamber 112 to create the dynamic underbalance may occur much faster than in a conventional gas pressure driven system. Additionally, the embodiments discussed above require comparatively fewer parts and a less complicated structure than conventional systems, thereby making manufacture and assembly more efficient and less expensive, as well as improving reliability in the generation of the dynamic underbalance.

Figure 3:
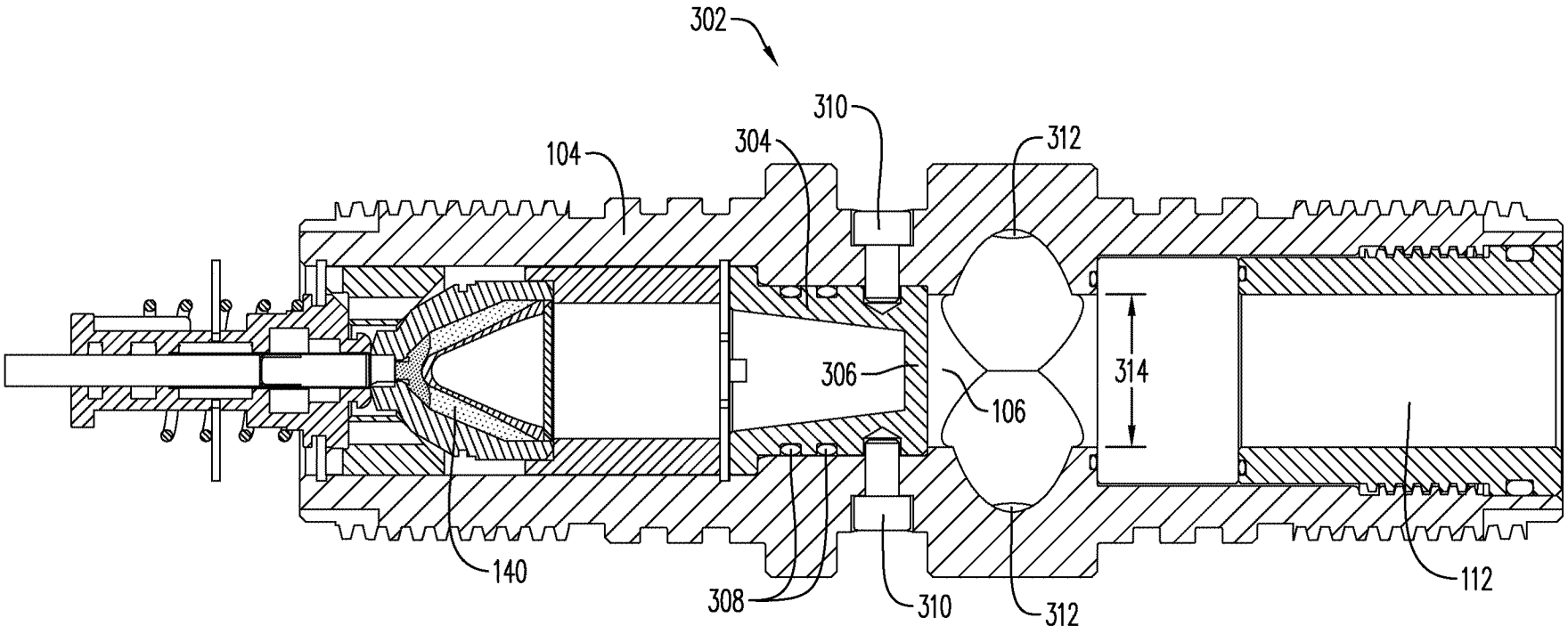
FIG. 3 illustrates a cross section of a dynamic underbalance sub according to an exemplary embodiment.

FIG. 3 shows an exemplary embodiment of a dynamic underbalance sub 302 in which the separation wall 144 shown in FIG. 1 is replaced with a spacer 304. The spacer 304 may include a spacer wall 306 that is similar in function to the separation wall 144. Spacer seals 308 may be provided between the spacer 304 and the sub housing 104 in a radial direction. Fasteners 310 may be inserted through the sub housing 104 in the radial direction to engage with the spacer 304 and maintain its position in the axial direction. The spacer 304 may be insertable and removable from the dynamic underbalance sub 302. Use of the spacer 304 may provide an advantage in that it allows for the dynamic underbalance sub 302 to be reused in multiple well deployments. After initiation, the dynamic underbalance sub 302 can be removed from the well, the perforated spacer 304 can be removed from the dynamic underbalance sub 302, and a new spacer 304 with an intact spacer wall 306 can be inserted into the dynamic underbalance sub 302 for another deployment. In this way, only the material for the material for the spacer 304 is spent for each deployment, instead of requiring an entirely new sub housing 104 due to a perforated separation wall 144.

Additionally, FIG. 3 shows an exemplary embodiment in which openings 312 are provided as approximately round holes through the sub housing 104, as compared with the elongated opening 108 shown in FIG. 1. The use of round openings 312 may result in improved structural stability of the dynamic underbalance sub 302 during wellbore operations. In an exemplary embodiment, a diameter of the opening 312 is at least as large as a diameter 314 between the first chamber 106 and the second chamber 112.

Figure 4:
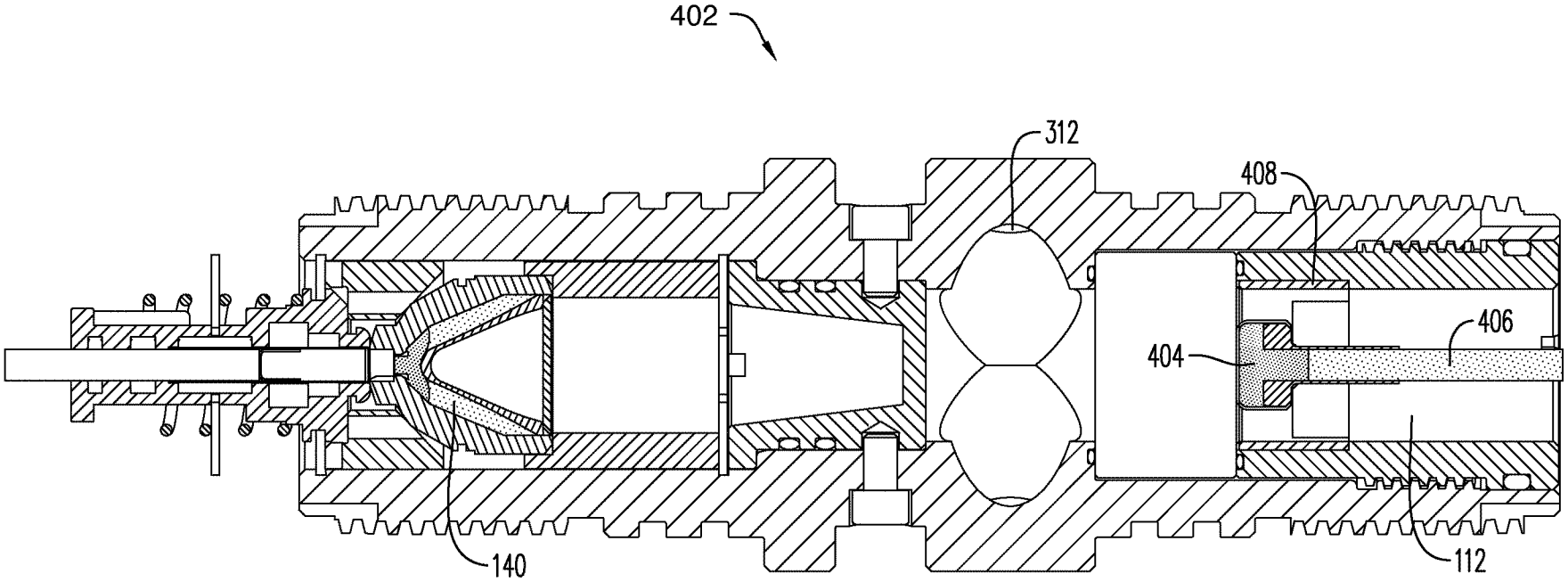
FIG. 4 illustrates a cross section of a dynamic underbalance sub according to an exemplary embodiment.

FIG. 4 shows an exemplary embodiment of a dynamic underbalance sub 402 which allows for ballistic transfer to downstream first wellbore tools. In the embodiments shown in FIG. 1, FIG. 2, and FIG. 3, the dynamic underbalance sub 102 or the dynamic underbalance sub 302 is placed at a downhole end of the wellbore tool string 202, as the ballistic continuity ends with the shaped charge 140. In the dynamic underbalance sub 402 shown in FIG. 4, a receiver explosive 404 is provided in the second chamber 112. In an exemplary embodiment, the receiver explosive 404 may be a receiver booster, but it will be understood that any explosive that can be initiated by the perforating jet of the shaped charge 140 may be used as the receiver explosive 404. The receiver explosive 404 may be held in place by a booster holder 408. The receiver explosive 404 may be ballistically coupled to a detonating cord 406, and the detonating cord 406 may in turn be ballistically coupled to elements in a downstream first wellbore tool. Upon initiation of the shaped charge 140, the perforating jet of the shaped charge 140 may initiate the receiver explosive 404, in turn initiating the detonating cord 406. This allows for ballistic transfer to further wellbore tools attached below the dynamic underbalance sub 402. For example, a second wellbore tool may be coupled to the dynamic underbalance sub 402 opposite the first wellbore tool 204, and an explosive within the second wellbore tool may be ballistically coupled to the receiver explosive 404 through the detonating cord 406. Thus, one or more dynamic underbalance subs 402 may be provided at various positions along a wellbore tool string in order to provide dynamic underbalance throughout the tool string, and the receiver explosive 404 in each dynamic underbalance sub 402 may provide ballistic continuity throughout the wellbore tool string.

Figure 5:
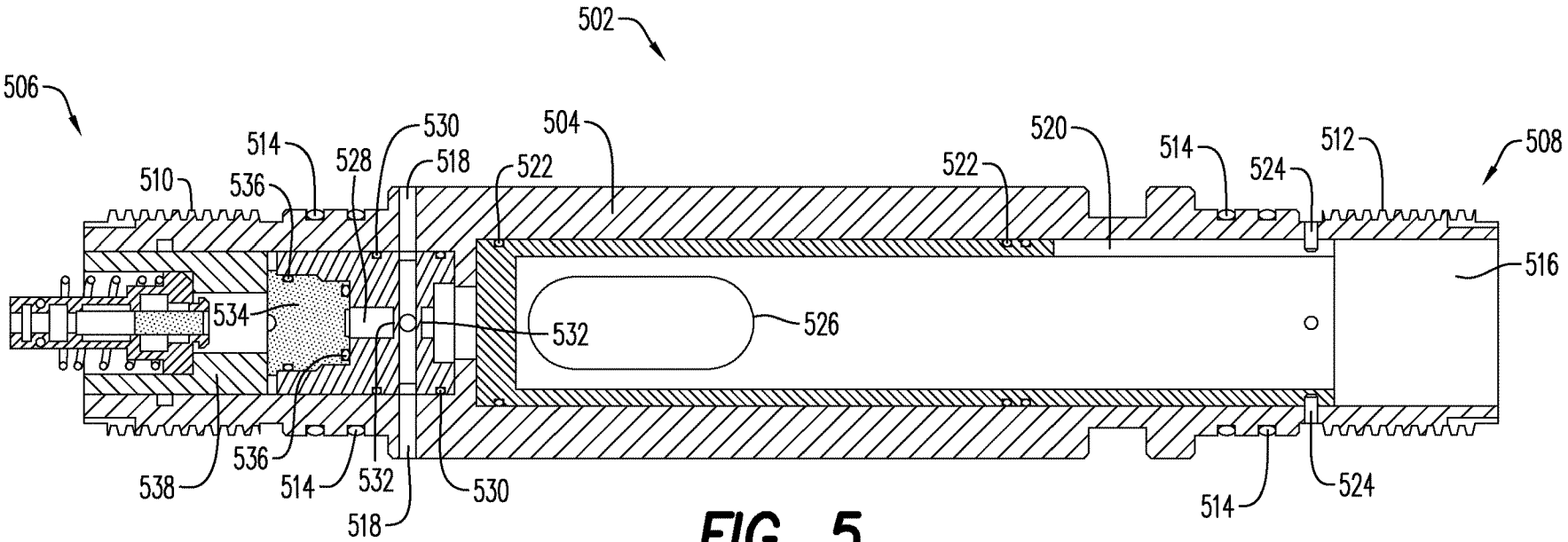
FIG. 5 illustrates a cross section of a dynamic underbalance sub prior to actuation according to an exemplary embodiment.

FIG. 5 show an exemplary embodiment of a dynamic underbalance sub 502 in a closed state, i.e., prior to actuation. As seen in FIG. 5, the sub has a sub body 504, which may be made of steel, with threads 510, 512 and seal elements 514 on an upper end 506 and a lower end 508 of the sub body 504. A hollow interior 516 may extend from the upper end 506 to the lower end 508. The sub body 504 may have two different types of openings into the hollow interior 516: one or more sub windows 702 (see FIG. 7) and one or more inflow channels 518. In the closed state shown in FIG. 5, the sub window 702 may be closed by a sliding sleeve piston 520 and its seals 522, which are located between the sliding sleeve piston 520 and the sub body 504. The sliding sleeve piston 520 may be held in place by one or more shear elements 524. The sliding sleeve piston 520 may include a piston window 526 which is displaced from the sub window 702 when the dynamic underbalance sub 502 is in a closed position as shown in FIG. 5.

The inflow channels 518 may allow fluid communication between the hollow interior 516 of the dynamic underbalance sub 502 and an exterior environment, i.e., the wellbore. A valve sealing block 528 may be located inside the hollow interior 516 to close the inflow channels 518 by using seals 530 axially displaced from the inflow channels 518. The sliding sleeve piston 520 may be axially displaced from the valve sealing block 528. Interior sealing block walls 532 may be located centrally in the valve sealing block 528. The interior sealing block wall 532 may have a small thickness so as to enable ballistic perforation thereof but are configured to withstand the surrounding wellbore pressure due to the relatively small surface area exposed to hydrostatic pressure. A valve actuating booster 534 may be axially displaced from the valve sealing block 528 in a direction opposite from the sliding sleeve piston 520. The valve actuating booster 534 may be an explosive pellet with a focused output or a perforation industry standard percussion initiator. The direction of detonation energy output of the valve actuating booster 534 is aimed toward the valve sealing block 528. On or more booster seals 536 may be configured to seal between the valve actuating booster 534 and the valve sealing block 528. In other words, the booster seals 536 may be provided between the valve actuating booster 534 and the valve sealing block 528 in a radial direction. The valve actuating booster 534 may be held by a booster holder 538. The booster holder 538 may be secured to the sub body 504 by using threads, as seen in FIG. 5, or by another suitable locking mechanism.

Figure 6:
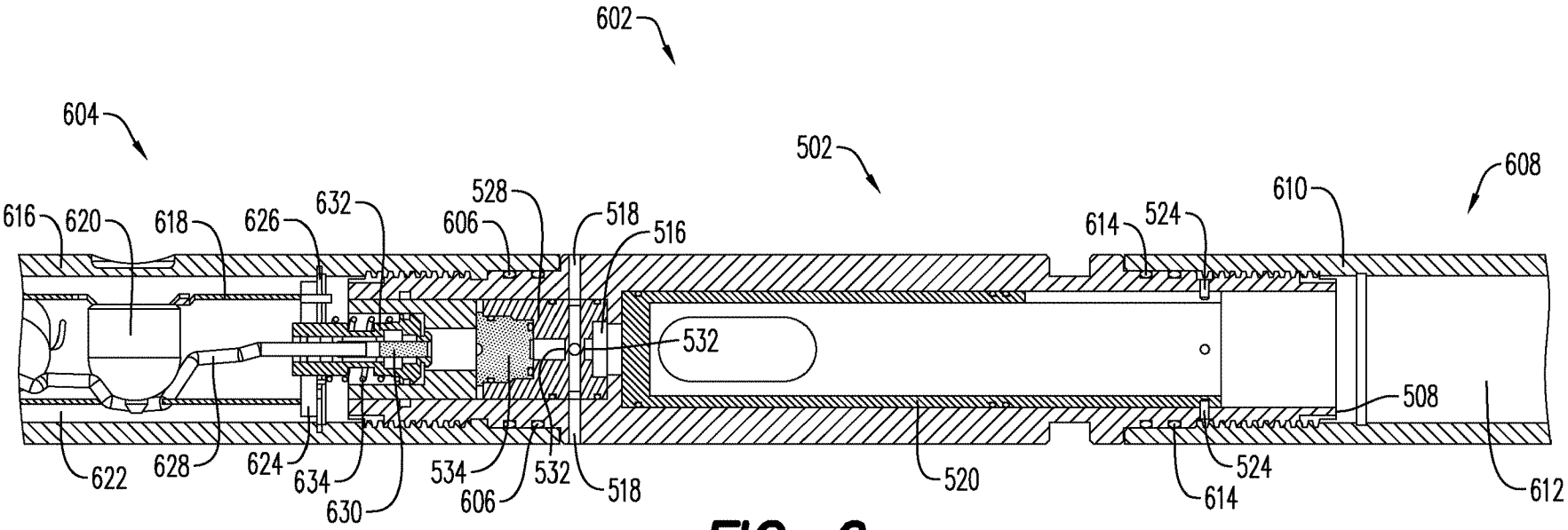
FIG. 6 illustrates a cross section of a dynamic underbalance sub according to an exemplary embodiment.

FIG. 6 shows an exemplary embodiment of a wellbore tool string 602 including the dynamic underbalance sub 502. A first end of the dynamic underbalance sub 502 is attached to a perforating gun 604 and the connection may be sealed with O-rings 606 positioned between the dynamic underbalance sub 502 and the perforating gun 604 in a radial direction. A second end of the dynamic underbalance sub 502 may be attached to a container 608. A container housing 610 of the container 608 may define a container interior 612. The container interior 612 may be maintained at a pressure substantially lower than the wellbore pressure. For example, the container interior 612 may be maintained at surface atmospheric pressure. Additionally, a connection between the dynamic underbalance sub 502 and the container 608 may be sealed by O-rings 614.

As further seen in FIG. 6, the perforating gun 604 may further include a gun housing 616. A charge tube 618 housing shaped charges 620 may be provided in a gun interior 622 of the perforating gun 604. An end plate 624 and a retainer ring 626 may be provided at each end of the charge tube 618 to fix a position of the charge tube 618 within gun housing 616. The shaped charges 620 may face toward an outside of the gun housing 616. A back side or apex of each shaped charge 620 may be attached to a detonating cord 628.

FIG. 6 further shows that an end of the detonating cord 628 may be coupled to a ballistic booster 630. The ballistic booster 630 may be held in place by a booster holder 632 in a fixed position relative to the perforating gun 604. The booster holder 632 may be fixed on the end plate 624 by a locking mechanism and a spring 634. The ballistic booster 630 may be located towards or proximate to the valve actuating booster 534 provided within the dynamic underbalance sub 502.

The valve may be actuated to an open position ballistically by piercing or perforating the interior sealing block walls 532. To activate the perforating gun 604, the detonating cord 628 may be initiated. Initiating the detonating cord 628 detonates each shaped charge 620, followed by the ballistic booster 630, which detonates and ruptures the interior sealing block walls 532. By rupturing the interior sealing block walls 532, fluid from the wellbore can rapidly pass through the inflow channels 518 and into the hollow interior 516 between the sliding sleeve piston 520 and the valve sealing block 528. With increasing pressure, the shear elements 524 may be sheared off and the sliding sleeve piston 520 may move towards the lower end 508 of the dynamic underbalance sub 502.

Figure 7:
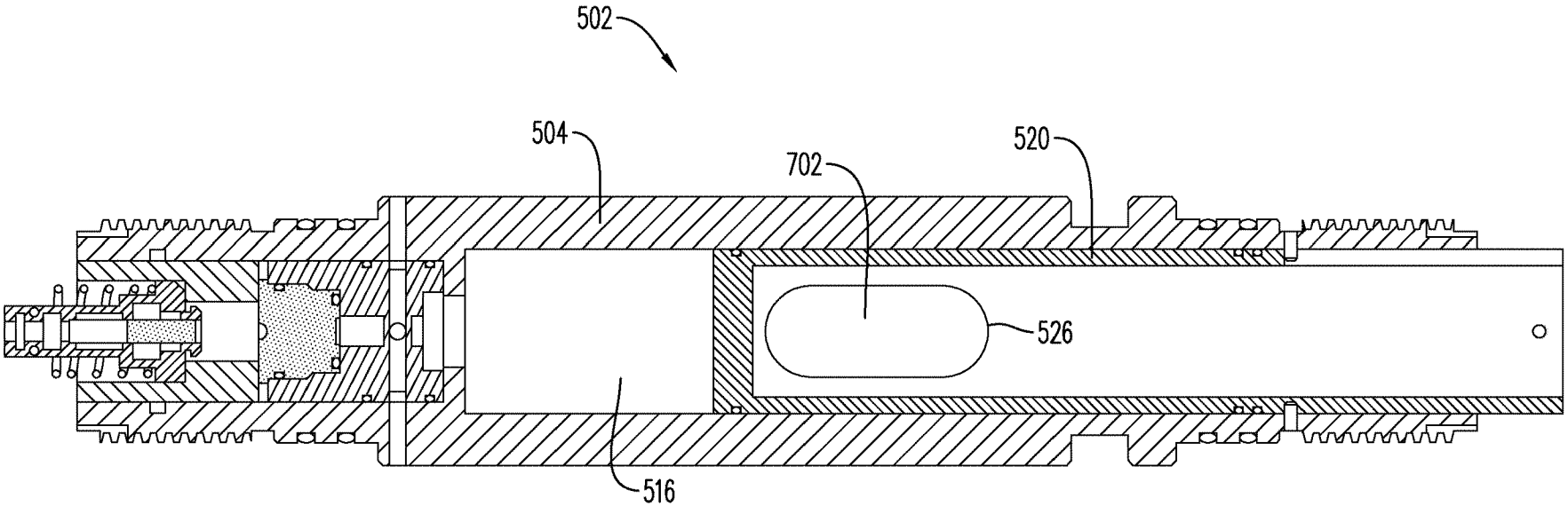
FIG. 7 illustrates a cross section of a dynamic underbalance sub after actuation according to an exemplary embodiment.

FIG. 7 shows an exemplary embodiment of the dynamic underbalance sub 502 in an open state after actuation. The sliding sleeve piston 520 reaches a position where the piston window 526 and the sub window 702 are aligned in the axial direction. Once the piston window 526 and the sub window 702 are aligned, the container interior 612 (see FIG. 6) is in fluid communication with the wellbore environment. Accordingly, because the pressure in the container interior 612 is substantially lower than the pressure in the wellbore environment, a negative pressure situation is created, and wellbore fluid will flow into the container interior 612. This flow of the wellbore fluid will remove the debris from the perforations in the surrounding formation and may also reduce the skin-damage in the perforation tunnel. In an exemplary embodiment, an amount of dynamic underbalance (e.g., an amplitude and/or duration of the dynamic underbalance condition) may be varied by varying a size of the container interior 612. For example, a variety of container sizes of container 608 may be manufactured, each having a different length, which consequently results in different sizes of the container interior 612. In an application where a relatively low amount of dynamic underbalance is desired, a shorter container 608 may be used. Alternatively, in an application where a relatively higher amount of dynamic underbalance is required, a longer container 608 could be used. A user may select the size of the container 608 to be used at the time of assembling the wellbore tool string 602.

Figure 8:
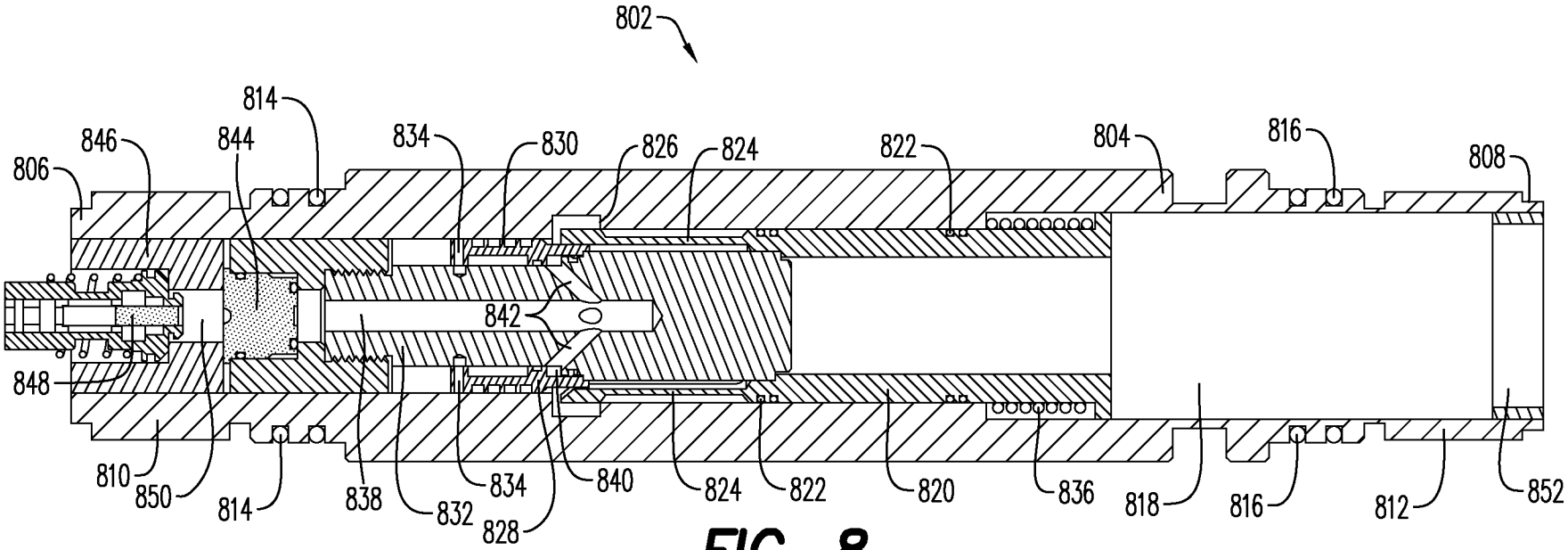
FIG. 8 illustrates a cross section of a dynamic underbalance sub according to an exemplary embodiment.

FIG. 8 shows an exemplary embodiment of a dynamic underbalance sub 802 in a closed state. As shown in FIG. 8, the dynamic underbalance sub 802 has a sub body 804, which may be made of steel, having a first end 806 and a second end 808. The sub body 804 may have threads 810, 812 and seal elements 814, 816 provided at each end. The sub body 804 may have a hollow interior 818 and a sub window 902 (see FIG. 9), which connects the hollow interior 818 with an exterior of the dynamic underbalance sub 802. In an exemplary embodiment, the exterior of the dynamic underbalance sub 802 would be a wellbore filled with a fluid or a gas.

The dynamic underbalance sub 802 may further include a sliding sleeve 820, a sleeve holding mechanism, and a valve actuating explosive element. The sliding sleeve 820 may be arranged inside the sub body 804 such that the sub window 902 is closed and sealed from the outside environment by sleeve seals 822. One end of the sliding sleeve 820 may be configured as a plurality of hook arms 824. The hook arms 824 may be coupled or engaged with a hook shoulder 826 inside the sub body 804. Without any load the hook arms 824 are configured to have a diameter less than the inner diameter of the hook shoulder 826. An arm retainer 828 may be attached to the hook arms 824, and may be configured to spread or deflect the hook arms 824 away from a center axis and towards the hook shoulder 826. The hook arms 824 may be resiliently or elastically biased so as to return to a position in which the hook arms 824 are not engaged with the hook shoulder 826 once the arm retainer 828 is removed. The arm retainer 828 may be sealed against an inner surface of the sub body 804 by arm retainer seals 830. The arm retainer 828 may be held by a sleeve holder 832 and secured by one or more shear elements 834.

As further seen in FIG. 8, a spring 836 may be provided at an end of the sliding sleeve 820 opposite the hook arms 824. In the closed state shown in FIG. 8, the spring 836 is in a compressed state between the sub body 804 and the sliding sleeve 820. A sleeve catcher 852 may be provided inside hollow interior 818 of the sub body 804 and attached to an inner surface of the sub body 804, next to the second end 808 of the dynamic underbalance sub 802.

FIG. 8 further shows that, in an exemplary embodiment, the sleeve holder 832 may have a bore 838 along its central axis, which may serve as a main gas channel. The outside of the sleeve holder 832 and the arm retainer 828 may form a cavity or pressure chamber 840. The pressure chamber 840 may be fluidly connected to the bore 838 by one or more distribution channels 842.

A valve actuating booster 844 may be positioned adjacent to the bore 838 and held in position by a booster holder 846. A second booster 848, for example, a tandem booster from a perforating gun, may be positioned separated from the valve actuating booster 844 by a booster gap 850. The valve actuating booster 844 may be a percussion initiator, a bi-directional booster, or a detonating cord.

When the valve actuating booster 844 is initiated by detonating the second booster 848, the valve actuating booster 844 produces a high amount of gas pressure. This gas pressure fills the bore 838, the distribution channels 842, and the pressure chamber 840. The pressure buildup inside the pressure chamber 840 forces the pressure chamber 840 to expand until the shear elements 834 shear off, thus allowing the arm retainer 828 to move in a direction toward the first end 806 of the dynamic underbalance sub 802. With the arm retainer 828 removed, the hook arms 824 are allowed to move towards the center axis due to the resilient/elastic bias, thereby disengaged from the hook shoulder 826. With the hook arms 824 no longer engaged with the hook shoulder 826, the sliding sleeve 820 is free to move in the axial direction. The bias force of the compressed spring 836 slides the sliding sleeve 820 toward the second end 808 of the dynamic underbalance sub 802. The movement of the sliding sleeve 820 may be stopped by the sleeve catcher 852.

Figure 9:
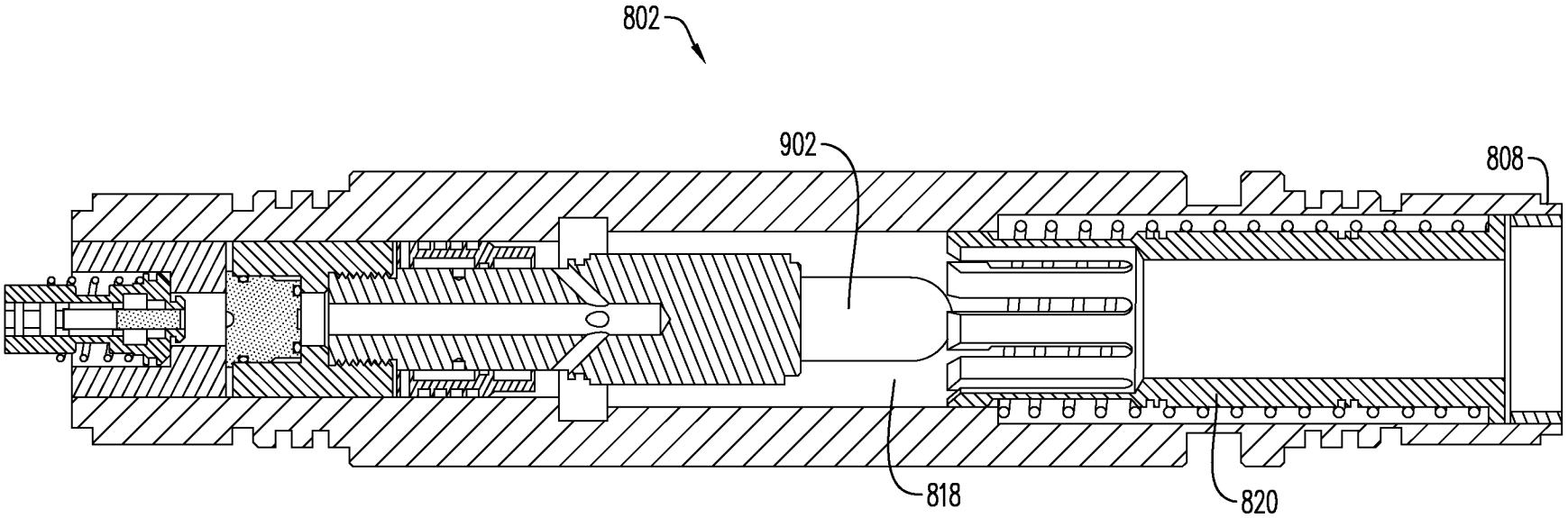
FIG. 9 illustrates a cross section of a dynamic underbalance sub according to an exemplary embodiment.

FIG. 9 shows an exemplary embodiment of the dynamic underbalance sub 802 in an actuated state in which the sliding sleeve 820 is displaced toward the second end 808 of the dynamic underbalance sub 802. Once the sliding sleeve 820 has been moved, the sub window 902 is exposed, thereby allowing fluid communication between the hollow interior 818 and an exterior of the dynamic underbalance sub 802.

Similar to the embodiments shown in FIG. 5, FIG. 6, and FIG. 7, a container may be coupled with the second end 808 of the dynamic underbalance sub 802. The inner volume of the container, which is at ambient pressure, may be flooded through the dynamic underbalance sub 802 by the fluid or gas from the wellbore increasing the effect of dynamic underbalance during perforation. In an exemplary embodiment, an amount of dynamic underbalance (e.g., an amplitude and/or duration of the dynamic underbalance condition) may be varied by changing a size of the interior of the container. For example, a variety of containers may be provided, each having a different length, which consequently leads to different sized interiors. In an application where a relatively low amount of dynamic underbalance is desired, a shorter container could be used. Alternatively, in an application where a relatively higher amount of dynamic underbalance is desired, a longer container could be used. A user could select the size of the container to be used at the time of assembling the tool string.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capabilityre, or possibility associated with the qualified verb. Accordingly, usage of "may" and "may be" indicates that a modified term is apparently appropriate, capable, or suitable for an indicated capacity, function, or usage, while considering that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A dynamic underbalance sub for use in a wellbore, the dynamic underbalance sub comprising:
- a sub housing;
- a first chamber provided in an interior of the sub housing;
- an opening extending through the sub housing and configured such that the first chamber is in fluid communication with an exterior of the sub housing;
- a second chamber provided in the interior of the sub housing;
- a pressure-isolating wall provided between the first chamber and the second chamber; and
- a shaped charge positioned to break or perforate the pressure-isolating wall in response to detonation of the shaped charge.

2. The dynamic underbalance sub of claim 1, wherein:
- the second chamber is pressure-sealed from the first chamber; and
- a second chamber pressure of the second chamber is less than a wellbore pressure of the wellbore.

3. The dynamic underbalance sub of claim 2, wherein the second chamber pressure is set to a surface atmospheric pressure.

4. The dynamic underbalance sub of claim 1, wherein the pressure-isolating wall comprises a glass or a ceramic.

5. The dynamic underbalance sub of claim 4, wherein the pressure-isolating wall comprises a borosilicate glass.

6. The dynamic underbalance sub of claim 1, wherein:
- the first chamber comprises a first interior surface having a first diameter;
- the second chamber comprises a second interior surface having a second diameter;
- the second diameter is larger than the first diameter;
- a shoulder extends between the first interior surface and the second interior surface; and
- the pressure-isolating wall is a disc abutting the shoulder.

7. The dynamic underbalance sub of claim 6, further comprising a seal element provided between the disc and the sub housing.

8. The dynamic underbalance sub of claim 6, further comprising:
- second chamber internal threads formed on the second interior surface; and
- a lock ring threadedly engaged with the second chamber internal threads and abutting the disc.

9. The dynamic underbalance sub of claim 1, wherein:
- the pressure-isolating wall is provided at a second chamber first end proximate to the first chamber;
- the second chamber comprises a second chamber second end spaced apart from the second chamber first end, the second chamber second end being open in an axial direction of the sub housing;
- the sub housing comprises sub housing external threads provided on an outer surface of the sub housing proximate to the second chamber second end; and
- the dynamic underbalance sub further comprises:
  - a container threadedly engaged with the sub housing external threads; and
  - a seal element provided between the container and the sub housing;
  - wherein the second chamber second end is disposed inside the container.

10. The dynamic underbalance sub of claim 1, further comprising a booster ballistically coupled to the shaped charge.

11. The dynamic underbalance sub of claim 1, further comprising a separation wall provided between the shaped charge and the first chamber.

12. The dynamic underbalance sub of claim 1, further comprising a removable spacer having a spacer wall provided between the shaped charge and the first chamber.

13. The dynamic underbalance sub of claim 1, further comprising a receiver explosive provided in the second chamber, the receiver explosive being configured so as to be initiated by a perforating jet caused by initiation of the shaped charge.

14. A wellbore tool string for use in a wellbore, the wellbore tool string comprising:
- a first wellbore tool comprising:
  - a tool housing; and
  - a tool explosive provided within the tool housing;
- a dynamic underbalance sub comprising:

a sub housing;

a first chamber provided in an interior of the sub housing;

an opening extending through the sub housing and configured such that the first chamber is in fluid communication with an exterior of the sub housing;

a second chamber provided in the interior of the sub housing;

a pressure-isolating wall provided between the first chamber and the second chamber; and a shaped charge ballistically coupled to the tool explosive and positioned to break or perforate the pressure-isolating wall in response to detonation of the tool explosive.

15. The wellbore tool string of claim 14, wherein the tool housing is threadedly coupled to the sub housing.

16. The wellbore tool string of claim 15, wherein:

the dynamic underbalance sub comprises:

a shaped charge chamber configured to receive the shaped charge;

a charge retainer threadedly engaged with the shaped charge chamber and configured to retain the shaped charge within the shaped charge chamber; and a booster extending through the charge retainer, a booster first end of the booster being ballistically coupled to the tool explosive and a booster second end being ballistically coupled to the shaped charge.

17. The wellbore tool string of claim 14, wherein:

the second chamber is pressure-sealed from the first chamber;

a second chamber pressure of the second chamber is less than a wellbore pressure of the wellbore.

18. The wellbore tool string of claim 14, wherein:

the pressure-isolating wall is provided at a second chamber first end proximate to the first chamber;

the second chamber comprises a second chamber second end that is open in an axial direction of the sub housing;

the sub housing comprises sub housing external threads provided on an outer surface of the sub housing proximate to the second chamber second end; and the dynamic underbalance sub further comprises:

a container threadedly engaged with the sub housing external threads; and a seal element provided between the container and the sub housing;

wherein the second chamber second end is provided inside the container.

19. The wellbore tool string of claim 14, further comprising:

a receiver explosive provided in the second chamber, the receiver explosive being configured so as to be initiated by a perforating jet caused by initiation of the shaped charge; and a second wellbore tool coupled to the dynamic underbalance sub opposite the first wellbore tool, the second wellbore tool being ballistically coupled to the receiver explosive.

* * * * *